US010704768B2

(12) United States Patent
Guercio et al.

(10) Patent No.: US 10,704,768 B2
(45) Date of Patent: Jul. 7, 2020

(54) METHODS AND APPARATUSES FOR CONNECTING LIGHTING ACCESSORIES TO LIGHTING FIXTURES

(71) Applicant: RAB Lighting Inc., Northvale, NJ (US)

(72) Inventors: Vincenzo Guercio, Wallkill, NY (US); Wengang Gao, Ningbo (CN)

(73) Assignee: RAB Lighting Inc., Northvale, NJ (US)

( * ) Notice: Subject to any disclaimer, the term of this patent is extended or adjusted under 35 U.S.C. 154(b) by 0 days.

(21) Appl. No.: 15/454,364

(22) Filed: Mar. 9, 2017

(65) Prior Publication Data

US 2018/0259162 A1 Sep. 13, 2018

(51) Int. Cl.
*F21V 17/12* (2006.01)
*F21V 17/00* (2006.01)
(Continued)

(52) U.S. Cl.
CPC ..... *F21V 17/002* (2013.01); *F21V 17/06* (2013.01); *F21V 17/12* (2013.01); *F21V 17/14* (2013.01); *F21V 23/06* (2013.01)

(58) Field of Classification Search
CPC ..... F21V 17/002; F21V 17/06; F21V 17/12; F21V 23/06; F21V 17/04; F21V 17/14; F21S 8/04
(Continued)

(56) References Cited

U.S. PATENT DOCUMENTS 3,027,416 A 3/1962 Kissel
3,112,891 A 12/1963 Cutler
(Continued)

FOREIGN PATENT DOCUMENTS

CA 140798 1/2012
CN 201130171304.1 11/2011
(Continued)

OTHER PUBLICATIONS

"Tyco Electronics 636452-000 Photocontrol 1000W 530V/Turn Lock", Product page; Retrieved from http://www.lightbulbsurplus.com/ty-m480.html on Oct. 14, 2016.

*Primary Examiner* — Evan P Dzierzynski
*Assistant Examiner* — Keith G. Delahoussaye
(74) *Attorney, Agent, or Firm* — Frost Brown Todd LLC; Douglas G. Gallagher; Kevin C. Oschman

(57) ABSTRACT

A lighting fixture adapter, methods for manufacturing a lighting fixture adapter, and methods for attaching a lighting accessory to a lighting fixture are disclosed. Embodiments include an adapter that connects to a lighting accessory and allows a user to connect the lighting accessory to a lighting fixture using less twisting than would normally be required when attaching the accessory to the fixture. Embodiments allow a lighting accessory that normally requires multiple rotations to operatively and/or fully engage with a lighting fixture to operatively and/or fully engage with the fixture using a maximum 360 degrees rotation, 180 degrees of rotation, 90 degrees of rotation, or no rotation. Some embodiments include a kit with one or more of: an adapter (which may include a flange), a replacement component for the lighting fixture (which may include a flange for engaging the adapter flange), wires, wiring connectors, an anti-rotation component, and a plug.

28 Claims, 9 Drawing Sheets

(51) Int. Cl.
*F21V 17/06* (2006.01)
*F21V 23/06* (2006.01)
*F21V 17/14* (2006.01)

(58) Field of Classification Search
USPC ..... 439/334, 537, 236, 299, 300, 309, 310, 439/311, 313, 641–644; 174/650, 655, 174/666, 669
See application file for complete search history.

(56) References Cited

U.S. PATENT DOCUMENTS

| | | | | |
|---|---|---|---|---|
| 3,358,870 | A | 12/1967 | Larkins | |
| 3,991,446 | A | 11/1976 | Mooney et al. | |
| 4,029,953 | A | 6/1977 | Natoli | |
| 4,302,035 | A | 11/1981 | Ochwat | |
| 4,969,074 | A | 11/1990 | Davis et al. | |
| 5,243,508 | A | 9/1993 | Ewing et al. | |
| 5,603,562 | A | 2/1997 | Huang | |
| 5,661,468 | A | 8/1997 | Marcoux | |
| 5,912,431 | A | 6/1999 | Sheehan | |
| 6,091,200 | A * | 7/2000 | Lenz | F21V 23/0442 315/158 |
| 6,146,191 | A * | 11/2000 | Kerr, Jr. | F04D 25/088 439/140 |
| 6,162,100 | A * | 12/2000 | Al-Turki | F21V 19/006 439/641 |
| 6,555,750 | B2 | 4/2003 | Kiely | |
| 6,940,012 | B2 | 9/2005 | Case | |
| 7,332,678 | B2 | 2/2008 | Pyron et al. | |
| D643,147 | S | 8/2011 | Guercio et al. | |
| 8,410,378 | B1 | 4/2013 | Senseney et al. | |
| 8,809,701 | B2 | 8/2014 | Levi | |
| 8,864,514 | B2 | 10/2014 | Ilyes | |
| 8,956,018 | B2 | 2/2015 | Seshpande et al. | |
| 9,273,863 | B2 | 3/2016 | Guercio et al. | |
| 9,442,215 | B2 | 9/2016 | Kovacs et al. | |
| 10,054,293 | B2 | 8/2018 | Guercio et al. | |
| 2005/0087354 | A1 | 4/2005 | Case | |
| 2005/0230141 | A1 | 10/2005 | Case | |
| 2006/0201957 | A1 | 9/2006 | Harrington et al. | |
| 2012/0106149 | A1* | 5/2012 | Boa | F21V 3/04 362/235 |
| 2013/0003346 | A1 | 1/2013 | Letoquin et al. | |
| 2014/0198527 | A1 | 7/2014 | Stephens | |
| 2015/0008829 | A1 | 1/2015 | Lurie et al. | |

FOREIGN PATENT DOCUMENTS

| | | |
|---|---|---|
| CN | ZL201220475032.3 | 7/2013 |
| MX | 36757 | 7/2012 |
| TW | 458690 | 10/2001 |
| TW | 391775 | 4/2013 |
| TW | D160717 | 5/2014 |
| WO | 2004088799 | 10/2004 |

* cited by examiner

METHODS AND APPARATUSES FOR CONNECTING LIGHTING ACCESSORIES TO LIGHTING FIXTURES

FIELD

Embodiments of this disclosure relate generally to adapters for connecting one component to another, including adapters that physically connect a lighting component to a lighting fixture.

BACKGROUND

It was realized by the inventors of the current disclosure that problems exist with connecting lighting accessories (such as motion sensors, light sensors, lighting controllers, etc.) to lighting fixtures. In particular, it was realized that the threaded connections frequently used to attach lighting components to lighting fixtures create difficulties for the users attaching the components to the lighting fixtures, such as the need to turn the component numerous times, which increases the complexity, potential for damage, and time required to attach the lighting accessory. Certain preferred features of the present disclosure address these and other needs and provide other important advantages.

SUMMARY

A typical manner in which an accessory (such as a motion sensor, light sensor, or controller capable of controlling the illumination of the lighting fixture) may be attached to a lighting fixture is by a threaded connection, where the threads of the accessory are engaged with the threads of the lighting fixture and the accessory is rotated through a large rotational distance (such as by rotating the accessory multiple times) until the accessory and lighting fixture are operatively and/or fully engaged. With at least threaded connections, two items are fully engaged when the maximum number of threads are engaged, which frequently occurs when a user is no longer able to rotate the two items with respect to one another without damaging at least one of the items. Two items are operatively engaged when the two items remain engaged with one another and function properly which with threaded connections can occur when less than the maximum number of threads are engaged.

While using a threaded connection may provide a secure connection, it can also be difficult for a user to use this type of connection. There are typically electrical wires operatively connecting the accessory to the lighting fixture, and rotating the accessory through a large rotational distance can result in the electrical wires becoming highly twisted, which can result in malfunctioning of the accessory, breakage of the wires, or other problems. To avoid the difficulties that come with twisting of the wires, the installer can pre-twist the wires (in the opposite direction to which the adapter is rotated when attaching it to the lighting fixture) so that the wires untwist when the accessory is connected to lighting fixture.

However, the inventors of this disclosure realized that not only is this method prone to errors, such as when the installer does not properly estimate the rotational distance (e.g., number of rotations) required to properly pre-twist the accessory, this method also increases the difficulty, time required, and potential for damage (and can cause other problems) when connecting the accessory to the lighting fixture. The methods and apparatuses disclosed herein decrease the difficulty, risk for damage, and time required to connect an accessory to a lighting fixture, as well as other advantages that may be impliedly if not explicitly discussed herein.

Embodiments of the present disclosure provide improved methods and apparatuses for connecting lighting accessories to lighting fixtures.

Embodiments of the present disclosure include adapters that physically connect a lighting component (e.g., a lighting accessory) to a lighting fixture (such as a high-bay lighting fixture). For example, some embodiments include an adapter that connects two components while providing a passage through the adapter to accommodate the passage of electrical wires between the two components. Some embodiments reduce the amount of twisting required to attach a lighting accessory to a lighting fixture, such as requiring at most 360 degrees, at most 180 degrees, 90 degrees, or zero degrees.

In at least one embodiment, an adapter (which may be relatively small when compared to the size of the accessory and the lighting fixture) with a threaded portion can be rotated onto the threaded portion of an accessory, typically until the adapter stops rotating. Another portion of the adapter is configured to attach the adapter to the lighting fixture with less rotation than required for the accessory to attach to the lighting fixture, increasing the ease of attaching the accessory to the lighting fixture and decreasing the likelihood of over-twisting the wires.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
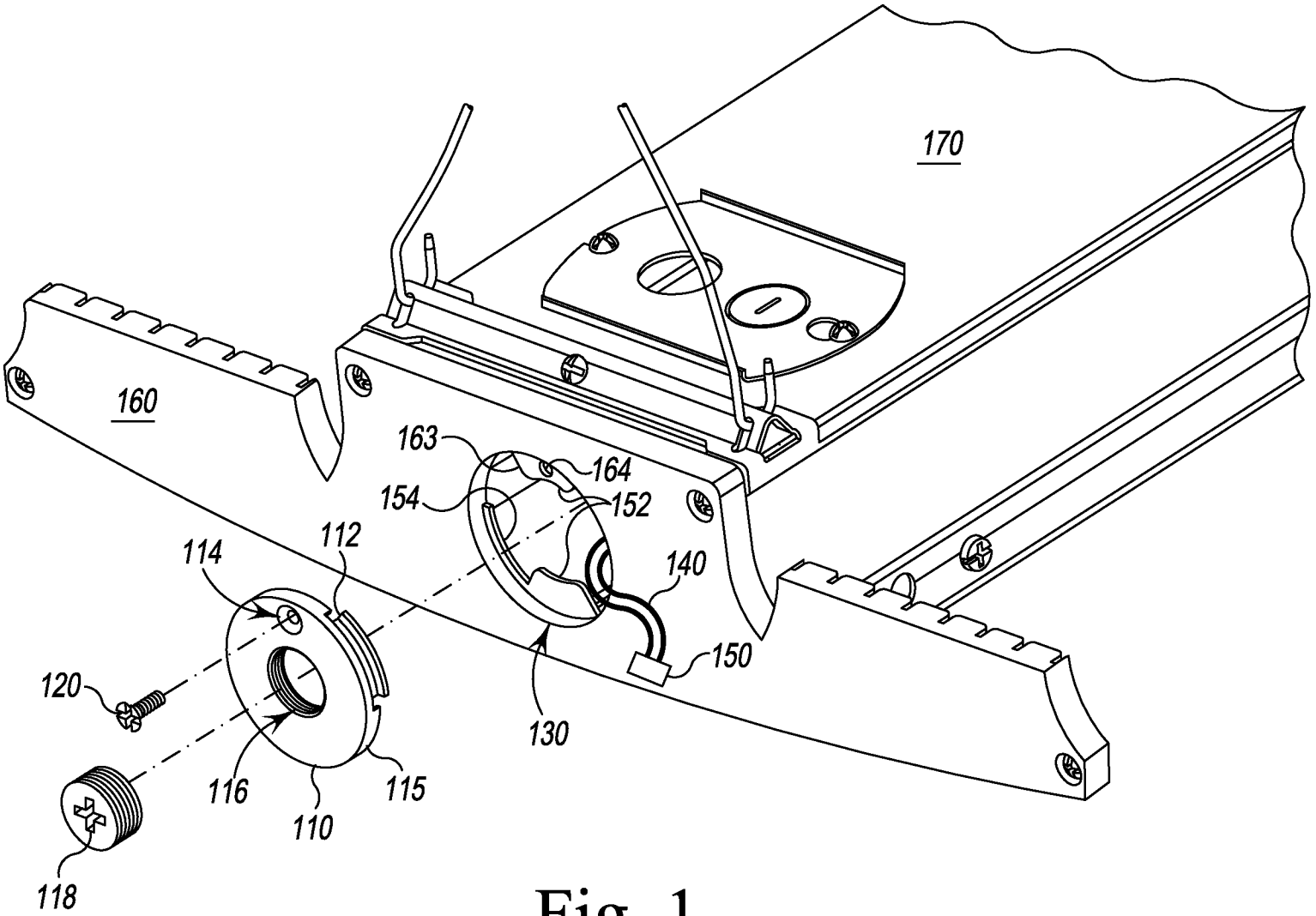
FIG. 1 is an exploded perspective view of an adapter according to one embodiment of the present disclosure.
Figure 2:
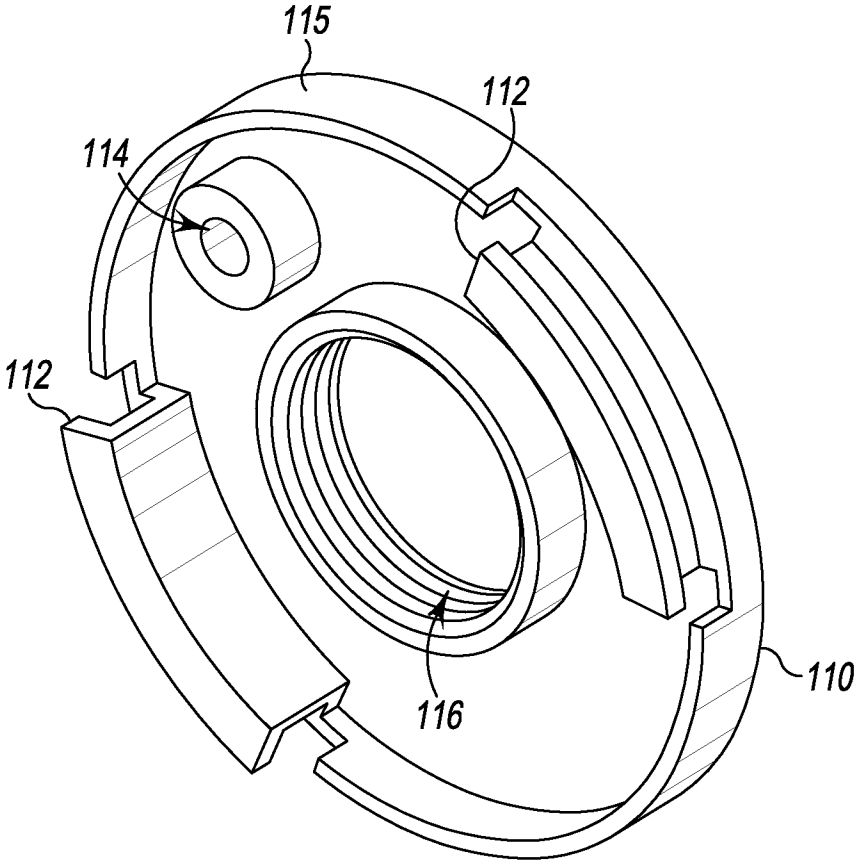
FIG. 2 is a reverse angle view of the adapter depicted in FIG. 1.
Figure 3:
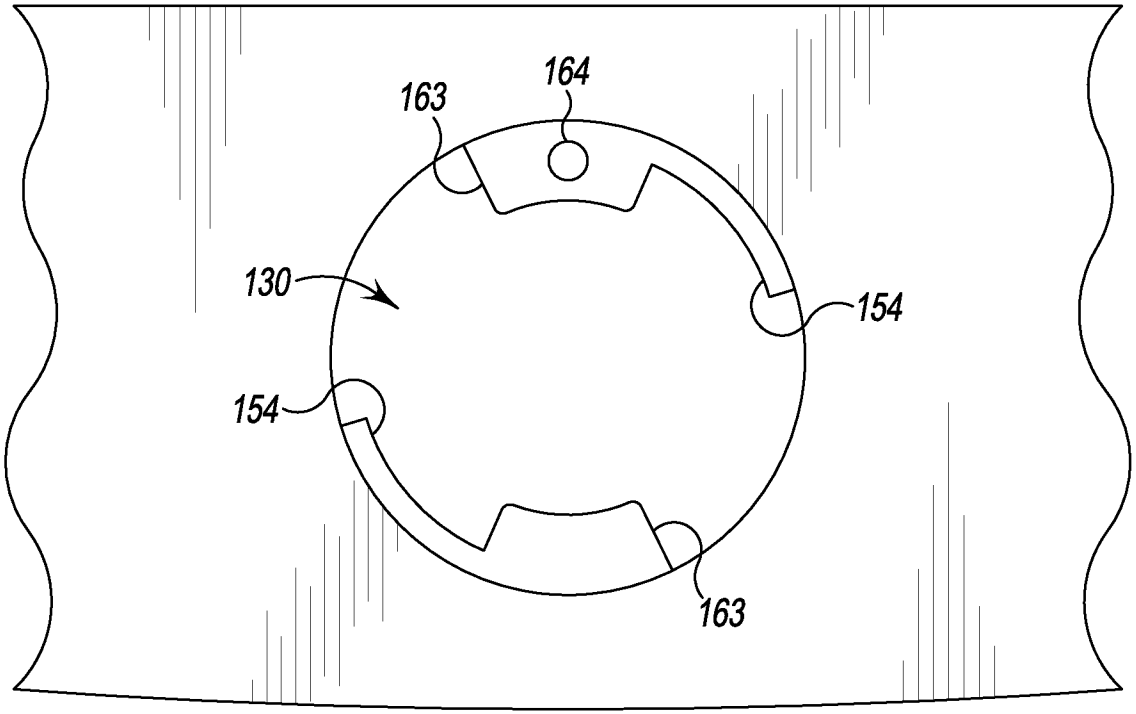
FIG. 3 is an enlarged, fragmentary view of the aperture depicted in FIG. 1.

For the purposes of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Likewise, there may be discussion with regards to "objects" associated with some embodiments of the present invention, it is understood that yet other embodiments may not be associated with those same objects, or may include yet different objects. Any advantages, objects, or similar words used herein are not to be construed as limiting to any of the claims. The usage of words indicating preference, such as "preferably," refers to features and aspects that are present in at least one embodiment, but which are optional for some embodiments.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Figure 4:
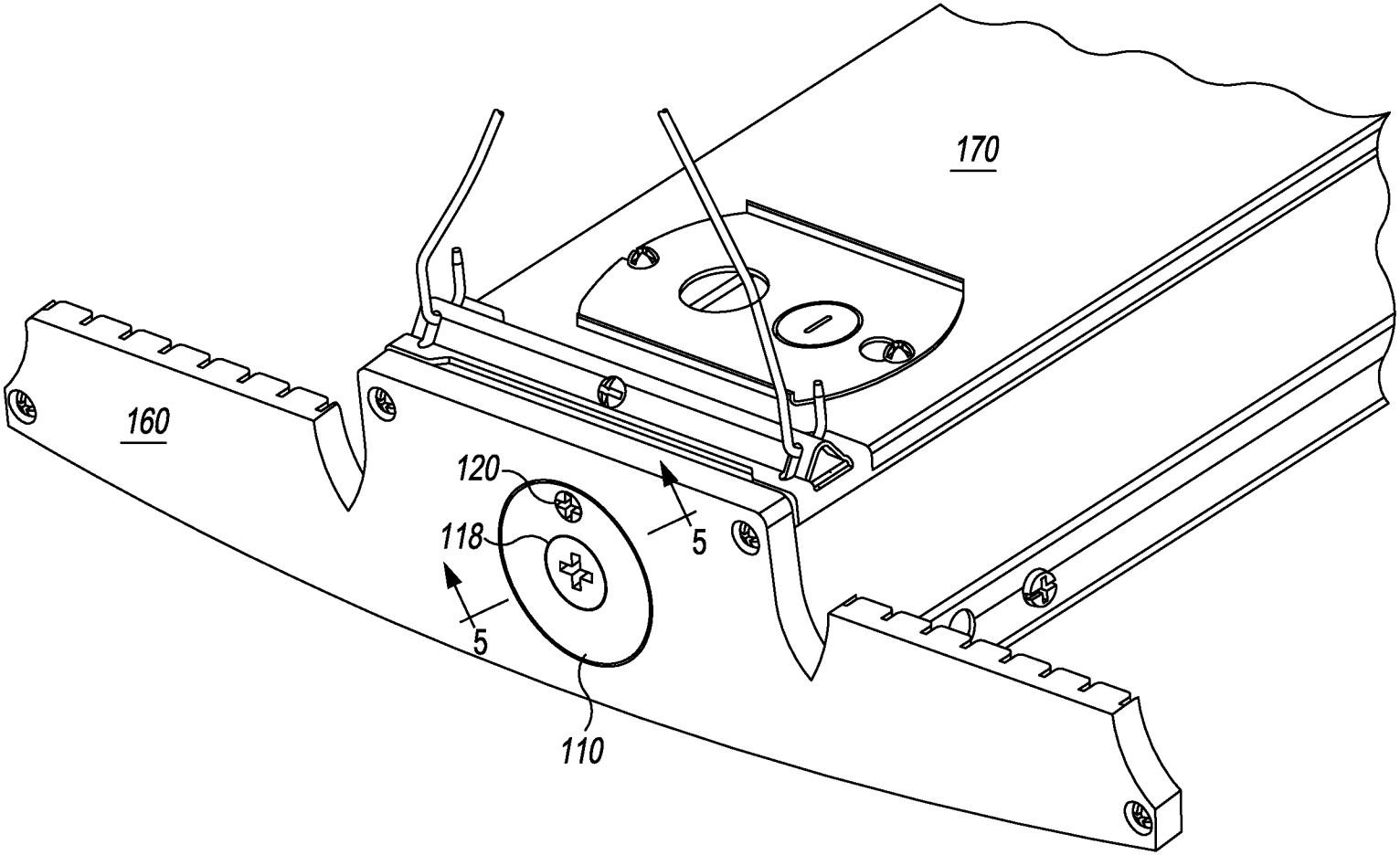
FIG. 4 is a perspective view of the adapter of FIG. 1 connected to a lighting fixture.
Figure 5:
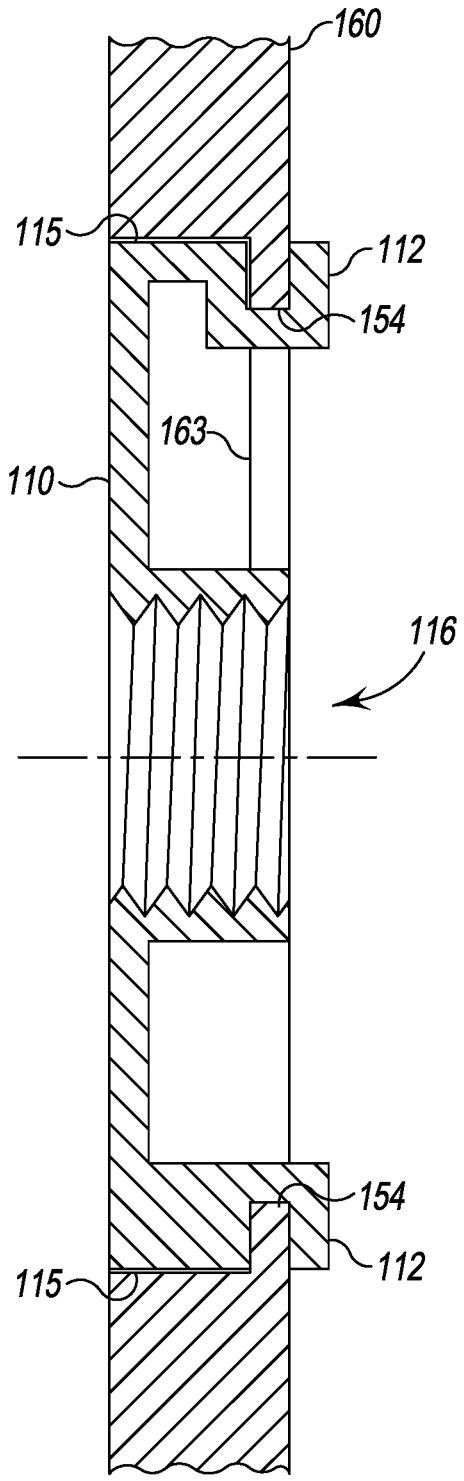
FIG. 5 is a sectional view of the adapter depicted in FIG. 4 taken along line 5-5.
Figure 6:
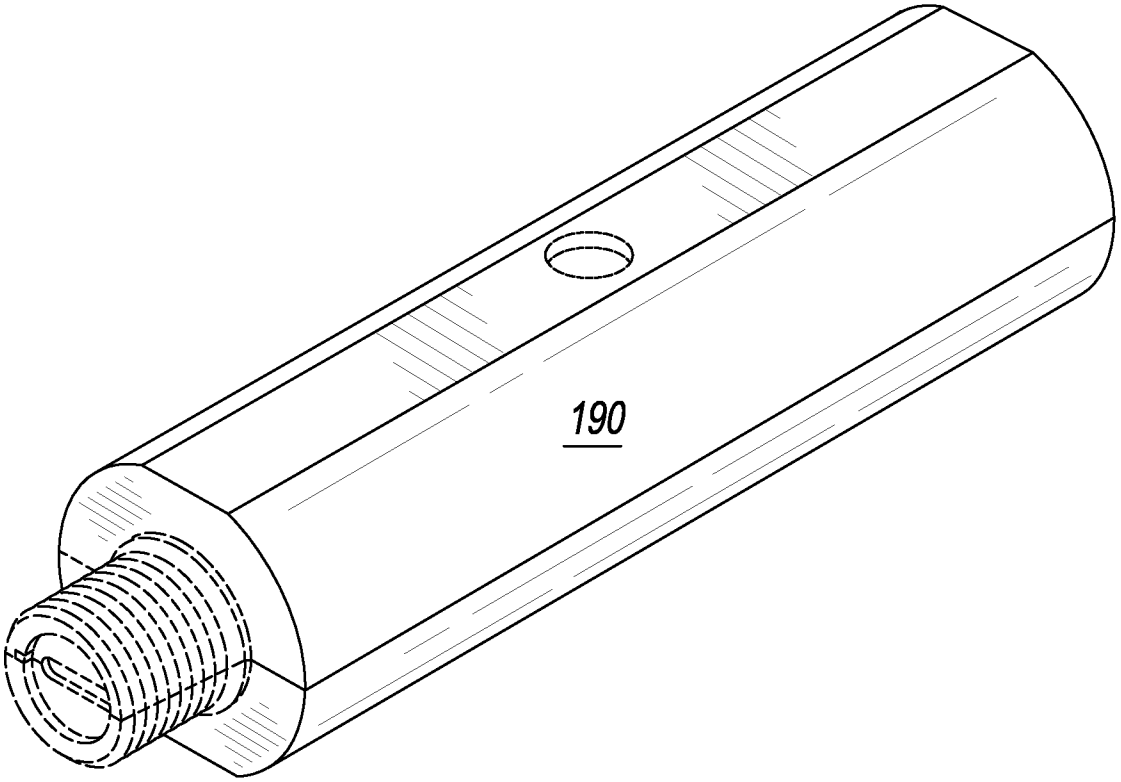
FIG. 6 is a perspective view of an example accessory that may be connected to a lighting fixture using, for example, the adapter depicted in FIG. 1.
Figure 7:
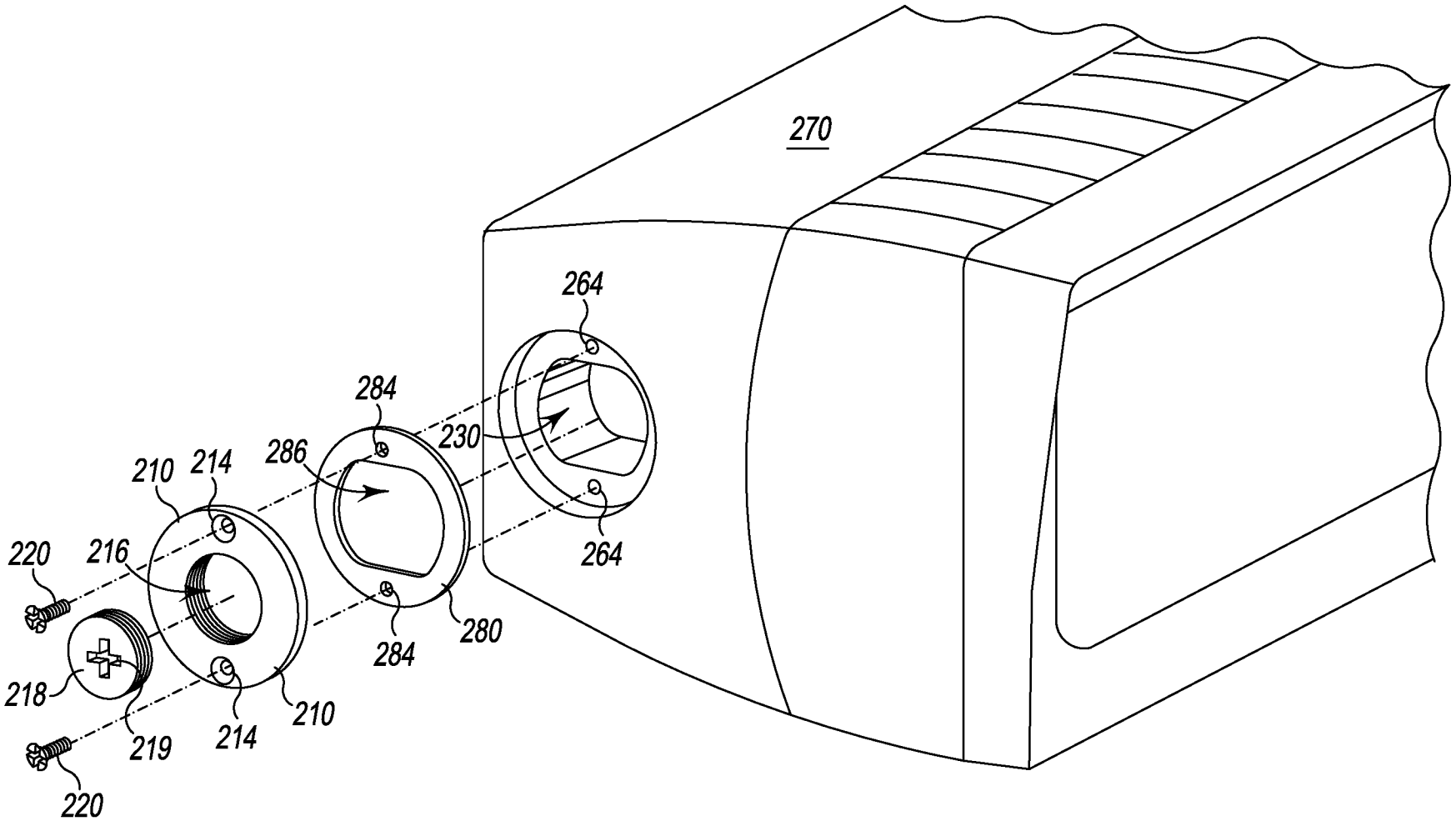
FIG. 7 is an exploded perspective view of an adapter according to another embodiment of the present disclosure.

Embodiments of the present disclosure provide adapters that reduce the complexity, time, and/or twisting required to attach a lighting accessory (such as the lighting accessory depicted in FIG. 6) to a lighting fixture (such as lighting fixture 170 depicted in FIGS. 1 and 4 and lighting fixture 270 depicted in FIG. 7). Since many types of lighting accessories are connected to lighting fixtures with electrical wires, embodiments of the present disclosure allow for the passage of electrical wires between the lighting accessory and the lighting fixture and reduce the amount of twisting to which the wires are subjected when attaching the lighting accessory to the lighting fixture. Some embodiment of the present disclosure also include wires and/or connectors that may be used when adapting an existing lighting fixture for use with the adapters disclosed herein.

Depicted in FIGS. 1-5 is an adapter 110 according to at least one embodiment of the present disclosure. Adapter 110 includes a portion (e.g., a threaded portion, such as aperture 116) for engaging an accessory (e.g., lighting accessory 190, see FIG. 6), and a portion (e.g., a non-threaded portion, such as outer surface 115) for engaging a lighting fixture (e.g., lighting fixture 170 or lighting fixture attachment member 160). The threads in threaded aperture 116 are configured to mate with and engage the threads of the lighting accessory 190. Outer surface 115 includes portions that engage the lighting fixture attachment member 160 and inhibit removal of adapter 110 (and lighting accessory 190 when connected to adapter 110) when fully engaged with the lighting fixture attachment member 160. For example, in at least one embodiment, outer surface 115 includes one or more engagement flanges 112 that engage with (e.g., abut against) a corresponding structure in lighting fixture attachment member 160, such as one or more engagement flanges 154 around the periphery of aperture 130.

Adapter 110 may optionally include an anti-rotation mechanism (such as aperture 114 and set screw 120) to inhibit rotation of adapter 110 when mated with the lighting fixture attachment member 160. For example, aperture 114 may receive a locking set screw 120, which may frictionally engage a portion of lighting fixture attachment member 160, such as flange 163. Set screw 120 may optionally be received in an aperture 164 in lighting fixture attachment member 160 to inhibit rotation of adapter 110 once attached to lighting fixture attachment member 160.

A plug 118 that engages aperture 116 (e.g., threadedly engages aperture 116) may be used to prevent foreign material from entering lighting fixture 170 in the event adapter 110 is connected to a lighting fixture 170 and an accessory is not (at least temporarily) connected to adapter 110. For example, in some embodiments the adapter 110 may be included as a portion of a lighting fixture (e.g., sold as a part of a lighting fixture) to provide an easy method for attaching an accessory to the lighting fixture. If a user decided to not install a lighting accessory, plug 118 could be left in place in aperture 116 of adapter 110 to protect the inside of lighting fixture 170 from foreign objects, such as dust and debris.

In embodiments where lighting fixture 170 is manufactured to include an aperture 130 for receiving adapter 110, adapter 110 may be connected directly to the lighting fixture 170. However, some embodiments of the present disclosure include a replacement part, such as lighting fixture attachment member 160, that can replace a portion of the lighting fixture 170 in order to provide the appropriate aperture 130 for receiving adapter 110 in situations where a lighting fixture does not include an aperture 130. For example, adapter 110 may be provided as part of a kit that includes lighting fixture attachment member 160. As such, a user could attach lighting fixture attachment member 160 to a lighting fixture, presumably after removing a similar portion of the lighting fixture that did not include an aperture 130, to provide an aperture 130 for attaching adapter 110.

In one example embodiment, such as that depicted in FIG. 1, aperture 130 includes one or more abutment flanges 152 which stop the insertion of adapter 110 at a location where engagement flanges 112 of adapter 110 will engage engagement flanges 154 of lighting fixture attachment member 160 when adapter 110 is rotated. Although engagement flanges 112 and 154 are generally depicted as being perpendicular to the direction in which adapter 110 is inserted into aperture 130 (and having surfaces that are perpendicular to the direction in which adapter 110 is inserted into aperture 130), other embodiments include flanges that are not perpendicular (i.e., at other than a 90 degree angle) to the direction in which adapter 110 is inserted into aperture 130, provided the flanges impede the removal of adapter 110 from aperture 130 while adapter 110 is in its rotationally engaged orientation with aperture 130.

The perimeter of aperture 130 may include a flange, for example flange 163, configured to inhibit adapter 110 from rotating once installed in aperture 130. For example, flange 163 can include a raised (or recessed) portion (not pictured), and adapter 110 can include a complimentary recessed (or raised) portion, resulting in increased friction between flange 163 and adapter 110 when adapter 110 is rotated away from its fully engaged orientation with aperture 130. Note that both flange 163 and adapter 110 can each include raised portions to increase friction when adapter 110 is rotated away from its fully engaged orientation. In some embodiments, the friction required to rotate adapter 110 to its fully installed orientation may decrease when adapter 110 reaches its fully engaged orientation.

As mentioned previously, flange 163 can provide a surface for engaging set screw 120, e.g., acting as a backstop against which set screw 120 can be tightened. Flange 163 may optionally include an aperture 164 for receiving set screw 120.

In use, a user may rotate adapter 110 onto a lighting accessory, such as lighting accessory 190 depicted in FIG. 6. The optional plug 118, if used, should be removed from aperture 116 prior to attaching adapter 110 to the accessory. To install adapter 110 onto the lighting accessory, adapter 110 is typically rotated through the same rotational distance (typically a large number of full rotations) that the lighting accessory would be rotated if being directly attached to the lighting fixture without using adapter 110. Full engagement between adapter 110 and the accessory is typically reached when adapter 110 and the accessory no longer rotate in relation to one another; however, operative engagement between adapter 110 and the accessory may occur before reaching full engagement. Since adapter 110 is relatively small, rotating adapter 110 onto the lighting accessory is much easier for the user than rotating the lighting accessory the same rotational distance onto the lighting fixture 170 without using adapter 110.

Once adapter 110 is connected to the lighting accessory, wires 140 within the lighting fixture 170 may be connected to wires in the lighting accessory using wires 140 and connector 150. A connector complimentary to connector 150 may either be included with the lighting accessory, or one or more additional wires and/or connectors configured to electrically connect the accessory to the lighting fixture 170, such as one or more connectors complimentary to connector 150, may also be included in a kit. Note that in some uses there may be no need to connect wires between the lighting accessory and the lighting fixture 170.

Adapter 110, with accessory 190 attached, may then be inserted into aperture 130. If the lighting fixture includes an aperture 130, the adapter 110 may be inserted directly into aperture 130 without any modification to the lighting fixture. However, if the lighting fixture does not include an aperture 130, then the lighting fixture can be modified to include an aperture 130, such as by replacing a portion of the lighting fixture with lighting fixture attachment member 160.

Once adapter 110 contacts the one or more abutment flanges 152, insertion of adapter 110 is stopped in a position where engagement flanges 112 of adapter 110 and engagement flanges 154 on the perimeter of aperture 130 align. To secure adapter 110 within aperture 130, a user rotates adapter 110 less than the rotational distance required to connect (either fully or operatively) the lighting accessory 190 onto the lighting fixture 170 without using adapter 110. For example, adapter 110 (with the lighting accessory 190 attached) may be rotated less than a full turn (e.g., at most a half-turn, or approximately a quarter-turn) so that engagement flanges 112 of adapter 110 engage engagement flanges 154 on the perimeter of aperture 130. The engagement of flanges 112 and 154 inhibit removal of adapter 110 from aperture 130.

In some embodiments, the force required to rotate adapter 110 in relation to lighting fixture 170 changes (e.g., increases or decreases) when the rotational distance needed for engagement (e.g., full engagement) has been reached. For example, some embodiments (such as the embodiment depicted in FIG. 1) include a tab (e.g., flange 152) that acts as a positive stop, increasing the force required to rotate adapter 110 with respect to lighting fixture 170. The connection between aperture 130 and adapter 110 may be configured such that the friction between adapter 110 and portions of the perimeter of aperture 130 is higher when adapter 110 is not in the fully engaged position and is at a lower value when in the fully engaged position. The friction may release after passing a particular point or detent as adapter 110 approaches and/or reaches full engagement. In some embodiments, adapter 110 includes a structure (e.g., a protrusion or detent) that cooperates with a complimentary structure (e.g., detent or protrusion) along the perimeter of aperture 130 to provide for increased friction between adapter 110 and aperture 130 as adapter 110 moves away from its fully engaged orientation in aperture 130.

Since engagement of the lighting accessory 190 with the lighting fixture 170 using adapter 110 requires less rotation than when connecting the lighting accessory 190 directly to the lighting fixture 170, the installation process is improved. For example, the wires connecting the lighting accessory to the lighting fixture need to be rotated through a much smaller rotational distance (typically a fraction of a full rotation (e.g., no more than a half-turn, such as a quarter turn) instead of multiple rotations), which reduces the twisting of the wires during installation and can eliminate the need to pre-twist the wires in the opposite direction to guard against over-twisting of the wires during installation. As another example, the user does not need to rotate the lighting accessory multiple times in order to attach the lighting accessory to the lighting fixture, which is typically located in a location that is relatively difficult to access.

If included, a user may then engage a device for preventing adapter 110 from de-rotating and disengaging from aperture 130. For example, set screw 120 can be inserted through aperture 114 of adapter 110 and engage flange 163, and optionally engage optional aperture 164 in flange 163.

Figure 8:
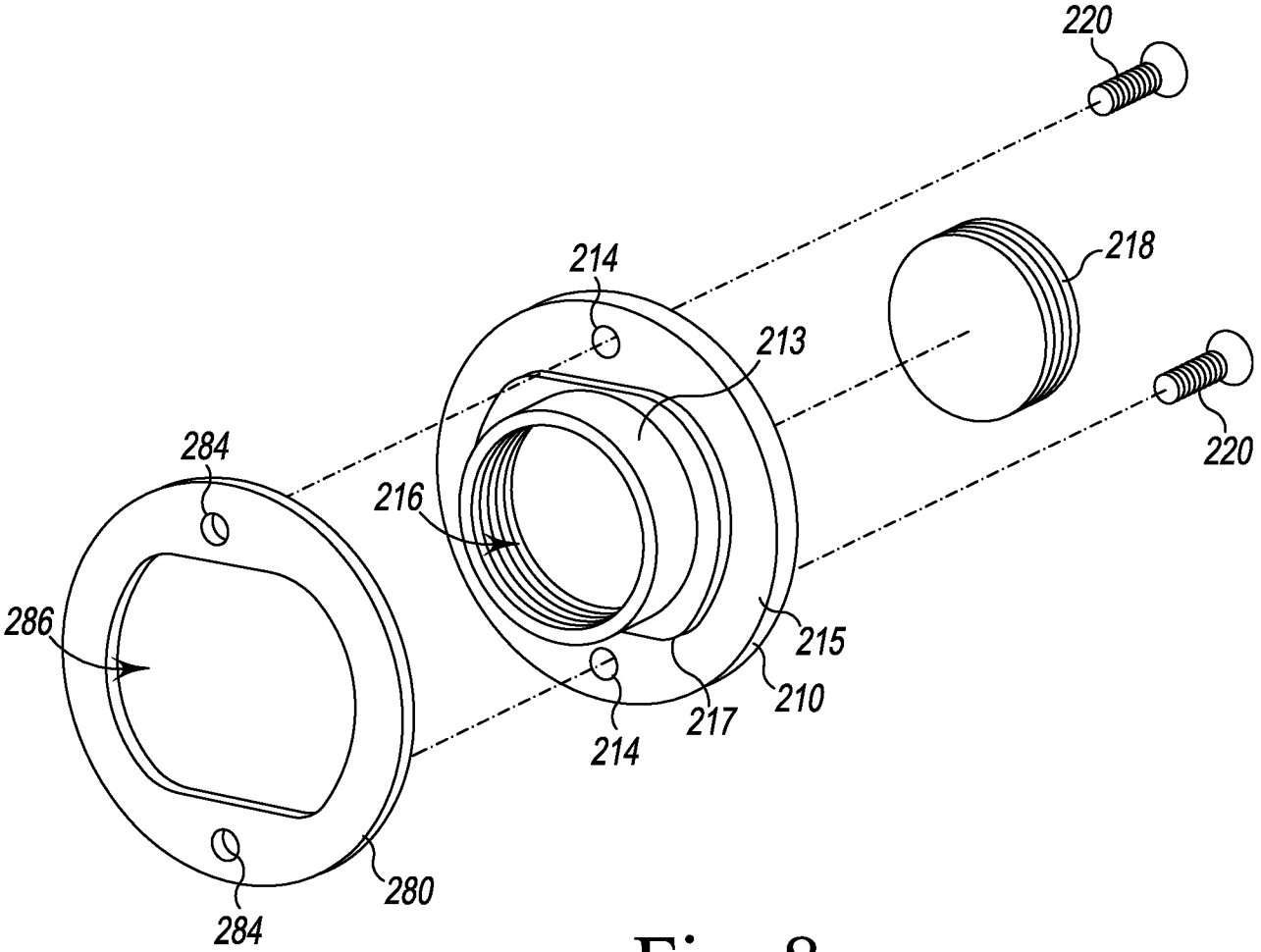
FIG. 8 is a reverse angle view of the adapter depicted in FIG. 7.

Depicted in FIGS. 7 and 8 is an adapter 210 according to at least one other embodiment of the present disclosure. Elements depicted in FIGS. 7 and 8 with reference numerals similar to or the same as those depicted in other figure(s), e.g., FIGS. 1-7, function similar to or the same as the elements in the other figure(s) except as shown and/or described. Adapter 210 includes a portion (e.g., threaded aperture 216) for engaging an accessory (e.g., lighting accessory 190, see FIG. 6), and a portion (e.g., surface 215, see FIG. 8) for engaging a lighting fixture (e.g., lighting fixture 170 or 270). The threads in threaded aperture 216 are configured to mate with and engage the threads of the lighting accessory 190. Surface 115 is configured to mate with the lighting fixture 270.

Adapter 210 may also include an attachment mechanism (such as aperture 214 and set screw 220) to inhibit rotation of adapter 210 when mated with the lighting fixture. For example, aperture 214 may receive a set screw 220, which may engage a portion of lighting fixture, such as aperture 264.

A plug 218 that engages aperture 216 (e.g., threadedly engages aperture 216) may be used to prevent foreign material from entering lighting fixture 270 in the event adapter 210 is connected to a lighting fixture and an accessory is not (at least temporarily) connected to adapter 210. For example, in some embodiments the adapter 210 may be included as a portion of a lighting fixture (e.g., sold as a part of a lighting fixture) to provide an easy method for attaching an accessory to the lighting fixture. If a user decided to not install a lighting accessory, plug 218 could be left in place in aperture 216 of adapter 210 to protect the inside of lighting fixture 170 or 270 from foreign objects, such as dust and debris.

In embodiments where lighting fixture 270 is manufactured to include an aperture 230 for receiving adapter 210, adapter 210 may be connected directly to the lighting fixture 270. However, some embodiments of the present disclosure include a replacement part that can replace a portion of the lighting fixture in order to provide the appropriate aperture 230 for receiving adapter 210. For example, adapter 210 may be provided as part of a kit that includes lighting fixture attachment member (similar to member 160) allowing a user to attach the lighting fixture attachment member to a lighting fixture, presumably after removing a similar portion of the lighting fixture that did not include an aperture 230, to provide an aperture 230 for attaching adapter 210.

In use, a user may rotate adapter 210 onto a lighting accessory, such as lighting accessory 190 depicted in FIG. 6. The optional plug 218, if used, should be removed from aperture 216 prior to attaching adapter 210 to the accessory. To install adapter 210 onto the lighting accessory, adapter 210 is typically rotated through the same rotational distance (typically a large number of full rotations) that the lighting accessory would be rotated if being directly attached to the lighting fixture without using adapter 210. Full engagement between adapter 210 and the accessory is typically reached when adapter 210 and the accessory no longer rotate in relation to one another; however, operative engagement between adapter 210 and the accessory may occur before reaching full engagement. Since adapter 210 is relatively small, rotating adapter 210 onto the lighting accessory is much easier for the user than rotating the lighting accessory the same rotational distance onto the lighting fixture 270 without using adapter 210.

Once adapter 210 is connected to the lighting accessory, wires within the lighting fixture 270 may be connected to wires in the lighting accessory using wires and connectors, for example, wires 140 and connectors 150. A connector complimentary to connector 150 may either be included with the lighting accessory, or one or more additional wires and/or connectors configured to electrically connect the accessory to the lighting fixture 270, such as one or more connectors complimentary to connector 150, may also be included in a kit. Note that in some uses there may be no need to connect wires between the lighting accessory and the lighting fixture 270.

Adapter 210, with accessory 190 attached, may then be inserted into aperture 230. If the lighting fixture includes an aperture 230, the adapter 210 may be inserted directly into aperture 230 without any modification to the lighting fixture. However, if the lighting fixture does not include an aperture 230, then the lighting fixture can be modified to include an aperture 230, such as by replacing a portion of the lighting fixture with lighting fixture attachment member.

To secure adapter 210 within aperture 230, a user inserts one or more set screws 220 through the one or more apertures 214 in adapter 210 and connects screws 220 to apertures 264 in lighting fixture 270. As such, the user rotates adapter 210 less than the rotational distance required to connect (either fully or operatively) the lighting accessory 190 onto the lighting fixture 270 without using adapter 210. In this example, adapter 210 (with the lighting accessory 190 attached) is not rotated, i.e., is rotated zero degrees to engage fixture 270.

Since engagement of the lighting accessory 190 with the lighting fixture 270 using adapter 210 requires less rotation than when connecting the lighting accessory 190 directly to the lighting fixture 270, the installation process is improved. For example, the wires connecting the lighting accessory to the lighting fixture do not need to be rotated, which reduces the twisting of the wires during installation and can eliminate the need to pre-twist the wires in the opposite direction to guard against over-twisting of the wires during installation. As another example, the user does not need to rotate the lighting accessory multiple times in order to attach the lighting accessory to the lighting fixture, which can be positioned in a location that is relatively difficult to access.

An optional gasket 280 may also be included with adapter 210. For example, when lighting fixture 270 is located in an outdoor environment, a user may optionally place gasket 280 between adapter 210 and lighting fixture 270 to create a water resistant fitting. Screws 220 may be inserted through apertures 214 of adapter 210, through complimentary apertures in gasket 280 (e.g., apertures 284), and into apertures 264 in lighting fixture 270. Adapter 210 may also include a raised portion 217 (see FIG. 8) for receiving the inner diameter of aperture 286 of gasket 280 to enhance the water resistant capabilities of adapter 210. In the illustrated embodiment, the inner surface of aperture 286 is not circular, which has advantages in assisting the user in aligning apertures 284 of gasket 280 and apertures 214 of adapter 210. However, alternate embodiments include an adapter 210 without a raised portion 217, where gasket 280 may include an aperture 216 that receives the outer surface 213 of aperture 216 to create a connection that inhibits water intrusion into lighting fixture 270. In alternate embodiments, adapter 210 may include an elastomeric coating on surface 215 to create a water resistant seal with lighting fixture 270.

Figure 10:
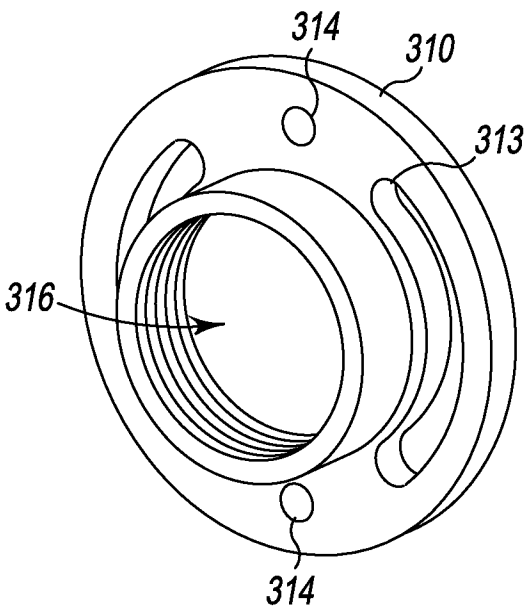
FIG. 10 is a reverse angle view of the adapter depicted in FIG. 9.
Figure 9:
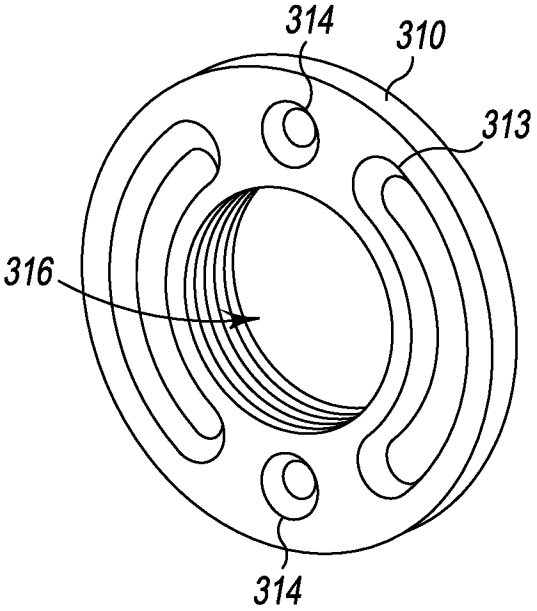
FIG. 9 is a perspective view of an adapter according to yet another embodiment of the present disclosure.

Depicted in FIGS. 9 and 10 is an adapter 310 according to at least another embodiment of the present disclosure. Elements depicted in FIGS. 9 and 10 with reference numerals similar to or the same as those depicted in other figure(s), e.g., FIGS. 1-8, function similar to or the same as the elements in the other figure(s) except as shown and/or described. Adapter 310 includes an aperture 316 for attaching a lighting accessory, such as lighting accessory 190. Adapter 310 also includes one or more apertures 314 for receiving a connector (e.g., a screw) for securing adapter 310 to a lighting fixture. Adapter 310 also includes apertures 313 which can assist with reducing the amount of material required to manufacture adapter 310, serve as tool receptacles for attaching adapter 310 to a lighting fixture, or can enhance the aesthetic appearance of adapter 310.

Some embodiments of the present disclosure provide a kit with one or more adapters (e.g., adapters 110, 210 or 310) that may be used for retrofitting existing lighting fixtures for use with the adapter or may be used to give users options when attaching lighting accessories to the lighting fixtures. In one example embodiment, a kit includes one or more parts with an aperture (e.g., one or more lighting fixture attachment members (such as, one or more lighting fixture attachment members 160), each with an aperture 130) configured and adapted to replace a corresponding part on the existing lighting fixture and receive an adapter (e.g., adapter 110, 210 or 310). By replacing an existing part on an existing lighting fixture with the replacement part, the user is able to use the adapter to attach lighting accessories to the lighting fixture.

In some embodiments, the kit includes one or more electrical wires 140, one or more connectors 150, and/or one or more connectors complimentary to connector 150, one or more plugs (e.g., plugs 118 or 218), one or more set screws (e.g., set screws 120 or 220), or any combination thereof. The electrical wires 140 can be connected to the appropriate wires within the lighting fixture 170 (or 270) and the lighting accessory 190 to provide an electrical connection between the lighting fixture and the lighting accessory 190. In embodiments where the electrical wires 140 include a connector 150, the user may simply connect wires 140 to the appropriate locations within the lighting fixture and connect connector 150 to a complimentary connector in the lighting accessory 190, or vice versa. If the lighting accessory does not include a complimentary connector, the kit may include additional wires and connectors so the user may select a complimentary connector and wires from the kit and connect the complimentary connector to the lighting accessory 190.

In some embodiments, lighting fixture attachment member 160 can include more than one aperture 130, thereby allowing attachment of more than one lighting accessory Although adapters 110, 210 and 310 are described as engaging a lighting fixture (e.g., lighting fixture 170 or 270) or a lighting fixture attachment member (e.g., lighting fixture attachment member 160), these descriptions are not limiting as adapter 110, 210 or 310 can engage any member (e.g., lighting fixture 170, lighting fixture 270, lighting fixture attachment member 160, or other member) with an aperture 130 or 230 for receiving and engaging adapter 110, 210 or 310.

In some embodiments, the adapter can contain an aperture which receives a portion of the lighting fixture attachment member 160 (or lighting fixture 170 or 270). For example, although the embodiments illustrated in FIGS. 1-5 depict a lighting fixture attachment member 160 (or lighting fixture 170) with connecting portion (e.g., an aperture 130) where the inner periphery of aperture 130 connects to the outer surface 115 of adapter 110, alternate embodiments include a lighting fixture attachment member 160 (or lighting fixture 170) with a connecting portion that has an outer periphery (which may have an outer surface similar to the outer surface 115 of adapter 110) that engages an inner periphery surface of an adapter. As another example, although the embodiments depicted in FIGS. 1-10 depict an adapter with a connection portion (e.g., apertures 116, 216 and 316, for receiving a portion of a lighting accessory 190, alternate embodiments include adapters with connecting portions that are received by apertures in the lighting accessories.

Various aspects of different embodiments of the present disclosure are expressed in paragraphs A1, A2, A3, and A3, as follows:

A1. One embodiment of the present disclosure includes an apparatus, comprising: an adapter including a first engagement portion and a second engagement portion, the first engagement portion configured and adapted to engage a lighting component by rotating the first engagement portion and the lighting component a first rotational distance with respect to one another, and the second engagement portion configured and adapted to engage a lighting fixture by rotating the second engagement portion and the lighting fixture a second rotational distance with respect to one another, wherein the first rotational distance is greater than the second rotational distance.

A2. Another embodiment of the present disclosure includes an adapter for connecting a lighting accessory to a lighting fixture, wherein without the adapter the lighting accessory connects to the lighting fixture by rotating the lighting accessory in relation to the lighting fixture, the adapter comprising: means for connecting the adapter to the lighting accessory, and means for connecting the adapter to the lighting fixture by rotating the adapter in relation to the lighting fixture less than required to connect the lighting accessory to the lighting fixture without the adapter.

A3. Another embodiment of the present disclosure includes a lighting accessory connection kit, comprising: an adapter including a lighting accessory connection portion configured and adapted to connect to a lighting accessory by rotating the adapter and the lighting accessory a first distance in relation to one another, and a lighting fixture connection portion configured and adapted to connect to a lighting fixture by rotating the adapter and the lighting fixture a second distance in relation to one another, wherein the second distance is less than the first distance; and a rotation inhibiting member configured and adapted to inhibit rotation of the adapter in relation to the lighting fixture once the adapter is engaged with the lighting fixture.

A4. Another embodiment of the present disclosure includes a method, comprising: forming a connection surface on a lighting fixture attachment member, the lighting fixture attachment member configured to attach to a lighting fixture; forming an adapter configured to connect to the lighting fixture attachment member and to a lighting accessory, said forming an adapter including forming a first connection surface, the first connection surface configured to fully engage with a lighting accessory by rotating the adapter and the accessory a first angular displacement in relation to one another, and forming a second connection surface, the second connection surface configured to fully engage with the connection surface on the lighting fixture attachment member by rotating the adapter and the lighting fixture attachment member a second angular displacement in relation to one another; wherein the first angular displacement is greater than the second angular displacement.

Yet other embodiments include the features described in any of the previous statements A1, A2, A3 or A4, as combined with (i) one or more of the previous statements A1, A2, A3 or A4, (ii) one or more of the following aspects, or (iii) one or more of the previous statements A1, A2, A3 or A4 and one or more of the following aspects:

Wherein the force required to rotate the first engagement portion and the lighting component with respect to one another increases when the first engagement portion and the lighting component are rotated the first rotational distance with respect to one another.

Wherein the force required to rotate the second engagement portion and the lighting fixture with respect to one another increases when the second engagement portion and the lighting fixture are rotated the second rotational distance with respect to one another.

Wherein the first rotational distance is greater than one complete revolution.

Wherein the second rotational distance is at most one-quarter of a complete revolution.

Wherein the second rotational distance is zero.

Wherein the first engagement portion includes threads configured and adapted to receive and engage threads on the lighting component.

Wherein the threads form an aperture in the adapter.

Wherein the second engagement portion includes at least one flange configured to engage a complimentary flange on a lighting fixture.

Wherein the second engagement portion is configured and adapted to be inserted into a lighting fixture receiving portion in a first direction and rotated after insertion to inhibit removal of the second engagement portion in a direction opposite the first direction.

Wherein the second engagement portion includes at least one inhibitor configured and adapted to engage the lighting fixture and inhibit rotation of the adapter with respect to the lighting fixture.

Wherein the inhibitor includes at least one set screw configured and adapted to engage the lighting fixture.

Wherein the adapter is disk shaped.

Wherein the adapter is disk shaped with the first engagement portion forming the inner periphery of the adapter and the second engagement portion forming the outer periphery of the adapter.

Wherein the means for connecting the adapter to the lighting accessory includes a threaded member requiring at least 360 degrees of rotation to fully engage the adapter and the lighting accessory.

Wherein the means for connecting the adapter to the lighting fixture includes a non-threaded member.

Wherein the means for connecting the adapter to the lighting fixture includes a non-threaded member requiring at most 180 degrees of rotation, at most 90 degrees of rotation, or no rotation to fully engage the adapter and the lighting fixture.

Means for inhibiting disconnection between the adapter and the lighting fixture.

Wherein the means for inhibiting disconnection includes at least one set screw.

Wherein the rotation inhibiting member is a set screw.

Wherein the adapter includes an aperture sized to receive the set screw and hold the set screw in contact with the lighting fixture.

Wherein the rotation inhibiting member is a raised portion on the lighting fixture connection portion.

One or more electrical wires connectable to electrical wires in the lighting fixture and to electrical wires in the lighting accessory.

One or more electrical connectors configured and adapted to connect to the one or more electrical wires.

Wherein the one or more electrical connectors enable a user to connect by hand, disconnect by hand, or connect and disconnect by hand the one or more wires to a complimentary electrical connector connected to wires in the lighting accessory or in the lighting fixture.

Wherein the adapter is circular with a threaded aperture defining the lighting accessory connection portion and an outer periphery with at least one flange defining the lighting fixture connection portion.

A lighting fixture attachment member configured and adapted for connection to a lighting fixture, wherein the lighting fixture attachment member includes an adapter receiving portion configured and adapted to receive and engage the lighting fixture connection portion of the adapter.

Wherein the first angular displacement is greater than 360 degrees and the second angular displacement is at most 180 degrees, 90 degrees, or zero degrees.

Wherein said forming a first connection surface includes forming a threaded surface on the adapter.

Wherein said forming a second connection surface includes forming a non-threaded surface on the adapter.

Forming a locking member configured to engage the adapter and the lighting fixture attachment member and inhibit rotation between the adapter and the lighting fixture attachment member.

Forming a raised portion on the second connection surface, the lighting fixture, or on both the second connection surface and the lighting fixture.

Forming a threaded screw.

Forming a passageway configured to accommodate passage of electrical wires between the lighting accessory and the lighting fixture attachment member when the lighting fixture attachment member, the adapter, and a lighting accessory are connected to one another.

Reference systems that may be used herein can refer generally to various directions (e.g., upper, lower, forward, rearward inner and outer), which are merely offered to assist the reader in understanding the various embodiments of the disclosure and are not to be interpreted as limiting. Other reference systems may be used.

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used in combination with some or all of the features of other embodiments as would be understood by one of ordinary skill in the art, whether or not explicitly described as such. At least one or more exemplary embodiments have been shown and described, and all changes and modifications that come within the spirit of the disclosure are desired to be protected.

Element Numbering

The following is a list of element numbers and at least one word used to describe the member and/or feature represented by the element number. It is understood that none of the embodiments disclosed herein are limited to these descriptions, and these element numbers can further include other words that would be understood by a person of ordinary skill reading and reviewing this disclosure in its entirety.

110 adapter

112 engagement portion (e.g., engagement flange or engagement protrusion)

114 aperture

115 outer surface

116 engagement portion (e.g., threaded aperture)

118 plug
120 set screw
130 aperture
140 electrical wires
150 connector
152 abutment flange
154 engagement flange
160 lighting fixture attachment member
163 flange
164 aperture
170 lighting fixture
190 lighting component, e.g., lighting accessory
210 adapter
213 outer surface
214 aperture
215 engagement surface
216 engagement portion (e.g., threaded aperture)
217 raised portion
218 plug
219 tool engagement portion
220 set screw
230 aperture
264 aperture
270 lighting fixture
280 gasket
284 aperture
286 aperture
310 adapter
313 aperture
314 aperture
316 aperture

What is claimed is:

1. An apparatus, comprising:

an adapter, including an aperture extending through the adapter, a first engagement portion and a second engagement portion, the aperture configured and adapted to allow wires extending through the aperture to rotate within the aperture;

the first engagement portion configured and adapted to engage a lighting accessory by rotating the first engagement portion and the lighting accessory a first rotational distance with respect to one another, and the second engagement portion configured and adapted to engage a lighting fixture by rotating the second engagement portion and the lighting fixture a second rotational distance with respect to one another, wherein the first rotational distance is greater than the second rotational distance; and wherein the lighting accessory is electrically connectable to the lighting fixture for adjusting a lighting output of the lighting fixture, and wherein the first engagement portion and the lighting accessory are disconnected from one another when the lighting accessory is disconnected from the adapter.

2. The apparatus of claim 1, wherein the force required to rotate the first engagement portion and the lighting accessory with respect to one another increases when the first engagement portion and the lighting accessory are rotated the first rotational distance with respect to one another.

3. The apparatus of claim 1, wherein the force required to rotate the second engagement portion and the lighting fixture with respect to one another increases when the second engagement portion and the lighting fixture are rotated the second rotational distance with respect to one another.

4. The apparatus of claim 1, wherein the first rotational distance is greater than one complete revolution and the second rotational distance is at most one-quarter of a complete revolution.

5. The apparatus of claim 4, wherein the second rotational distance is zero.

6. The apparatus of claim 1, wherein the first engagement portion includes threads configured and adapted to receive and engage threads on the lighting accessory.

7. The apparatus of claim 6, wherein the threads define the aperture.

8. The apparatus of claim 1, wherein the second engagement portion includes at least one flange configured to engage a complimentary flange on a lighting fixture.

9. The apparatus of claim 1, wherein the second engagement portion is configured and adapted to be inserted into a lighting fixture receiving portion in a first direction and rotated after insertion to inhibit removal of the second engagement portion in a direction opposite the first direction.

10. The apparatus of claim 9, wherein the second engagement portion includes at least one inhibitor configured and adapted to engage the lighting fixture and inhibit rotation of the adapter with respect to the lighting fixture.

11. The apparatus of claim 1, wherein the second engagement portion is non-threaded.

12. The apparatus of claim 1, wherein the adapter is disk shaped with the first engagement portion forming the inner periphery of the adapter and the second engagement portion forming the outer periphery of the adapter.

13. The apparatus of claim 1, further comprising:

a plug configured and adapted to engage with the first engagement portion;

wherein the plug is connectable to the first engagement portion upon disconnection of the lighting accessory.

14. The apparatus of claim 1, wherein the adapter is of unitary construction.

15. A lighting accessory connection kit, comprising:

an adapter including a lighting accessory connection portion configured and adapted to connect to a lighting accessory by rotating the adapter and the lighting accessory a first distance in relation to one another, and a lighting fixture connection portion configured and adapted to connect to a lighting fixture by rotating the adapter and the lighting fixture a second distance in relation to one another, wherein the second distance is less than the first distance; and a plug configured and adapted to connect to the accessory connection portion by rotating the adapter and the plug the first distance in relation to one another;

wherein the plug and the lighting accessory are disconnected from one another when the lighting accessory is disconnected from the adapter.

16. The lighting accessory connection kit of claim 15, further comprising:

a rotation inhibiting member configured and adapted to inhibit rotation of the adapter in relation to the lighting fixture once the adapter is engaged with the lighting fixture.

17. The lighting accessory connection kit of claim 16, wherein the rotation inhibiting member is a set screw, and the adapter includes an aperture sized to receive the set screw and hold the set screw in contact with the lighting fixture.

18. The lighting accessory connection kit of claim 15, further comprising:

one or more electrical wires connectable to electrical wires in the lighting fixture and to electrical wires in the lighting accessory.

19. The lighting accessory connection kit of claim 18, further comprising:

one or more electrical connectors configured and adapted to connect to the one or more electrical wires, wherein the one or more electrical connectors enable a user to connect by hand, disconnect by hand, or connect and disconnect by hand the one or more wires to a complimentary electrical connector connected to wires in the lighting accessory or in the lighting fixture.

20. The lighting accessory connection kit of claim 15, further comprising:

a lighting fixture attachment member configured and adapted for connection to a lighting fixture, wherein the lighting fixture attachment member includes an adapter receiving portion configured and adapted to receive and engage the lighting fixture connection portion of the adapter.

21. A method, comprising:

forming a connection surface on a lighting fixture attachment member, the connection surface defining an aperture configured and adapted to accept electrical wiring therethrough, the lighting fixture attachment member configured to attach to a lighting fixture; and forming an adapter configured to connect to the lighting fixture attachment member and to a lighting accessory, said forming an adapter including forming a first connection surface, the first connection surface configured to fully engage with the lighting accessory or, alternatively, fully engage with a plug, the first connecting surface fully engaging with the lighting accessory by rotating the adapter and the accessory a first angular displacement in relation to one another, and the first connection surface fully engaging with the plug by rotating the adapter and the plug a second angular displacement in relation to one another, and forming a second connection surface, the second connection surface configured to fully engage with the connection surface on the lighting fixture attachment member by rotating the adapter and the lighting fixture attachment member a third angular displacement in relation to one another;

wherein the first angular displacement is greater than the third angular displacement and the second angular displacement is greater than the third angular displacement.

22. The method of claim 21, wherein the first angular displacement is greater than 360 degrees, the second angular displacement is greater than 360 degrees, and the third angular displacement is at most 90 degrees.

23. The method of claim 21, wherein said forming a first connection surface includes forming a threaded surface on the adapter.

24. The method of claim 21, wherein said forming a second connection surface includes forming a non-threaded surface on the adapter.

25. The method of claim 21, wherein said forming an adapter includes:

forming a locking member configured to engage the adapter and the lighting fixture attachment member and inhibit rotation between the adapter and the lighting fixture attachment member.

26. The method of claim 21, wherein said forming an adapter includes:

forming a passageway configured to accommodate passage of electrical wires between the lighting accessory and the lighting fixture attachment member when the lighting fixture attachment member, the adapter, and the lighting accessory are connected to one another.

27. The method of claim 21, further comprising:

forming a plug configured and adapted to engage with the first connection surface when the lighting accessory is disconnected from the first connection surface.

28. The method of claim 21, wherein said forming an adapter includes forming an adapter of unitary construction.

* * * * *